US011820644B2

(12) United States Patent
Darby

(10) Patent No.: US 11,820,644 B2
(45) Date of Patent: Nov. 21, 2023

(54) TAP ASSEMBLY

(71) Applicant: Corplex Plastics UK Ltd., Gloucester (GB)

(72) Inventor: Ian Darby, Leicestershire (GB)

(73) Assignee: LB EUROPE LIMITED, Manchester (GB)

( * ) Notice: Subject to any disclaimer, the term of this patent is extended or adjusted under 35 U.S.C. 154(b) by 3 days.

(21) Appl. No.: 17/591,193

(22) Filed: Feb. 2, 2022

(65) Prior Publication Data

US 2022/0153567 A1 May 19, 2022

Related U.S. Application Data

(62) Division of application No. 16/612,532, filed as application No. PCT/GB2018/051257 on May 10, 2018, now Pat. No. 11,332,358.

(30) Foreign Application Priority Data

May 12, 2017 (GB) ..... 1707628

(51) Int. Cl.
*B67D 3/04* (2006.01)

(52) U.S. Cl.
CPC ..... *B67D 3/043* (2013.01)

(58) Field of Classification Search
CPC ..... B67D 1/1256; B67D 3/04–048
See application file for complete search history.

(56) References Cited

U.S. PATENT DOCUMENTS

| | | | | |
|---|---|---|---|---|
| 540,844 A | | 6/1895 | Schlueter et al. | |
| 2,197,352 A | | 4/1940 | Terkel | |
| 3,258,178 A | | 6/1966 | Gran | |
| 3,730,224 A | * | 5/1973 | Prisk | F16K 27/02 137/625.33 |
| 4,218,014 A | * | 8/1980 | Tracy | B67D 1/0049 222/145.5 |
| 4,628,579 A | * | 12/1986 | Taylor | F16J 15/48 29/422 |
| 4,664,297 A | | 5/1987 | Giovinazzi | |

(Continued)

FOREIGN PATENT DOCUMENTS

| | | |
|---|---|---|
| FR | 2388191 A1 | 11/1978 |
| GB | 2333288 A | 7/1999 |

(Continued)

OTHER PUBLICATIONS

International Search Report and Written Opinion, Application No. PCT/GB2018/051257, dated Oct. 23, 2018, 21 pages.

*Primary Examiner* — Patrick M. Buechner
(74) *Attorney, Agent, or Firm* — McAndrews, Held & Malloy, Ltd.

(57) ABSTRACT

A tap assembly with a hollow tap body which defines a dispensing chamber leading to an outlet arrangement. A valve assembly with a valve element is provided to selectively open an inlet into the dispensing chamber. A push button is provided which operates the valve assembly, and which defines an operating chamber, with the push button movable into the operating chamber. A connecting member is provided extending from the push button through the operating chamber. A seal is provided to prevent liquid passing from the dispensing chamber to the operating chamber.

19 Claims, 19 Drawing Sheets

(56) References Cited

U.S. PATENT DOCUMENTS

| | | | | |
|---|---|---|---|---|
| 6,401,752 | B1 | 6/2002 | Blackbourn et al. | |
| 10,065,849 | B2 * | 9/2018 | Van Der Molen | F16K 41/04 |
| 2007/0181615 | A1 * | 8/2007 | Allanson | B65D 47/248 222/509 |
| 2009/0301572 | A1 | 12/2009 | Nini | |
| 2014/0070126 | A1 * | 3/2014 | Robinson | F16K 31/1221 251/333 |
| 2018/0186522 | A1 | 7/2018 | Kieras et al. | |

FOREIGN PATENT DOCUMENTS

| | | | | |
|---|---|---|---|---|
| GB | 2448703 | A * | 10/2008 | B67D 1/08 |
| WO | WO-2004052772 | A1 * | 6/2004 | B67D 3/043 |
| WO | 2007135641 | A1 | 11/2007 | |

* cited by examiner

TAP ASSEMBLY

This application is a Division of U.S. patent Ser. No. 16/612,532, filed on Nov. 11, 2019, which claims priority to PCT/GB2018/051257, filed on May 10, 2018, which claims priority to GB Application No. 1707628.2, filed on May 12, 2017. The aforementioned applications are incorporated herein by reference and made a part hereof.

This invention concerns a tap assembly, and especially a tap assembly mountable on bottles or other containers for dispensing liquids.

Tap assemblies may be provided mountable on bottles or other containers for dispensing liquids from the container. Such containers are often disposable or recyclable after use. The containers may include liquids such as water, wine, juices, or milk. With such tap assemblies, it is important to ensure that during dispensing of the liquid, the liquid being dispensed and that remaining in the container does not become contaminated. With some liquids, such as for instance water, even a very small amount of contamination can be noticeable and is thus significant.

According to a first aspect of the invention there is provided a tap assembly, the tap assembly including a partially hollow body which defines a dispensing chamber within the body with a liquid inlet and a liquid outlet, the liquid inlet being located to receive liquid to be dispensed by the tap assembly, the liquid outlet connecting to an outlet arrangement for the tap assembly, a valve assembly to selectively open the dispensing chamber liquid inlet, the valve assembly including a valve element selectively movable between a position closing the dispensing chamber liquid inlet and a position permitting liquid to pass therethrough, a push button for operating the valve assembly, the push button defining an operating chamber against part of the body, such that as the push button is pushed to operate the valve assembly the push button moves into the operating chamber, a connecting member which extends from the push button through the operating chamber, through an opening in a part of the body, and into the dispensing chamber to the valve element, with a seal provided in the opening in a part of the body to prevent liquid passing from the dispensing chamber to the operating chamber.

The opening in the body may comprise a deformable part which is deformed by the connecting member extending through the opening, and which deformable part forms a swipe seal against the connecting member.

The deformable part may be in the form of a lip around the opening which is inclined away from the dispensing chamber.

The lip may be deflected by the connecting member extending through the body, by between 0.1 and 0.4 mm.

The part of the connecting member which extends through the opening may be cylindrical.

The lip may be integrally formed with the remainder of the body.

According to a second aspect of the invention there is provided a tap assembly, the tap assembly including a partially hollow body which defines a dispensing chamber within the body with a liquid inlet and a liquid outlet, the liquid inlet being located to receive liquid to be dispensed by the tap assembly, the liquid outlet connecting to an outlet arrangement for the tap assembly, a valve assembly to selectively open the dispensing chamber liquid inlet, the valve assembly including a valve element selectively movable between a position closing the dispensing chamber liquid inlet and a position permitting liquid to pass therethrough, a push button for operating the valve assembly, the push button defining an operating chamber against part of the body, such that as the push button is pushed to operate the valve assembly the push button moves into the operating chamber, a connecting member which extends from the push button through the operating chamber, through an opening in a part of the body, and into the dispensing chamber to the valve element, the body defining an air inlet separate from the outlet arrangement, and an air intake passage which extends from the air inlet to an air outlet connecting to the dispensing chamber spaced from the outlet arrangement, the air intake passage being isolated from the connecting member and the push button.

The air intake passage may extend through a part of the body without connecting to the opening or operating chamber.

The air intake passage may extend through a part of the body to one side of the opening.

The assembly may include a vent for the operating chamber, which vent extends between the operating chamber and the air intake passage adjacent to the air inlet. The vent may be provided on the opposite side of the opening to the side which the air intake passage extends through.

According to a third aspect of the invention there is provided a tap assembly, the tap assembly including a partially hollow body which defines a dispensing chamber within the body with a liquid inlet and a liquid outlet, the liquid inlet being located to receive liquid to be dispensed by the tap assembly, the liquid outlet connecting to an outlet arrangement for the tap assembly, a valve assembly to selectively open the dispensing chamber liquid inlet, the valve assembly including a valve element selectively movable between a position closing the dispensing chamber liquid inlet and a position permitting liquid to pass therethrough, a push button for operating the valve assembly, the push button defining an operating chamber against part of the body, such that as the push button is pushed to operate the valve assembly the push button moves into the operating chamber, a connecting member which extends from the push button through the operating chamber, through an opening in a part of the body, and into the dispensing chamber to the valve element, the outlet arrangement including a spout having a linear edge with a recess in the edge.

The recess may extend for at least 40% of the width of the spout.

The recess may have a depth of at least 20% of the width of the spout.

The recess may extend for at least 50%, perhaps 55 and perhaps 60% of the width of the spout.

A pair of opposed fins may be provided extending into the spout. The fins may extend for between 10 and 20% of the width of the spout. The fins may be symmetrical about a central line through the recess.

The spout may include a first part with at least generally arcuate walls which extend for at least 180°, and a second part interconnecting ends of the first part, the second part including the recess.

The fins may be provided on the first part. The spout may be symmetrical about a line extending through the centres of the first and second parts.

The lower edge of the walls of the first part may be substantially planar, and may be inclined relative to the lower edge of the walls of the second part adjoining the first part, with the lower edge of the walls of the first part at a greater inclination in use to the horizontal, than the lower edge of the walls of the second part adjoining the first part.

The push button may be made of a deformable resilient material.

A selectively removable cap may be provided extendible over the tap assembly body.

An embodiment of the present invention will now be described by way of example only and with reference to the accompanying drawings, in which:—

Figure 7:
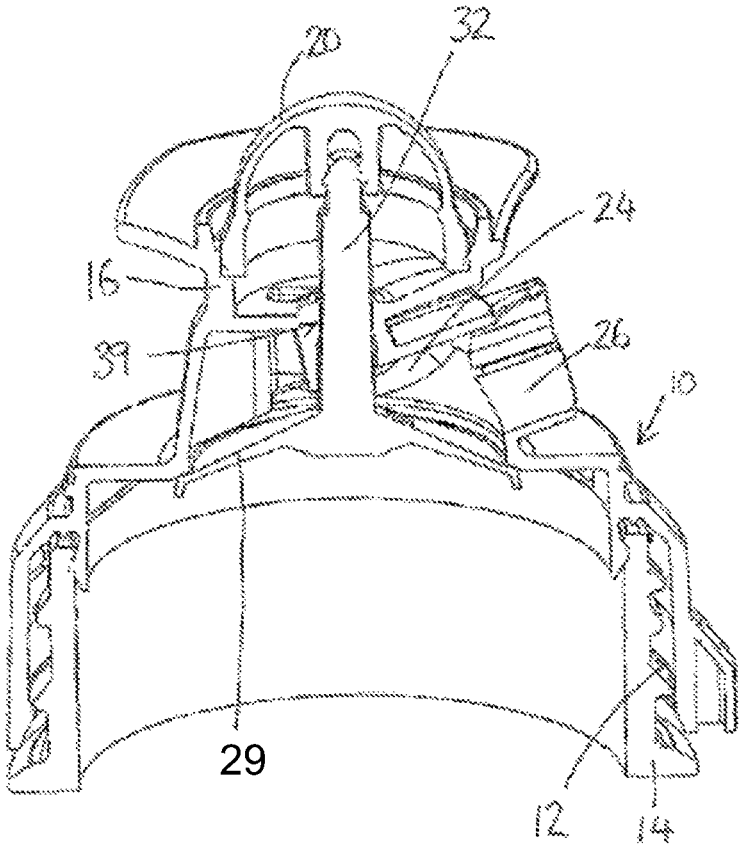
FIGS. 7 and 8 are respectively diagrammatic partially cut away views of the assembly of FIG. 1 in open and closed positions.
Figure 8:
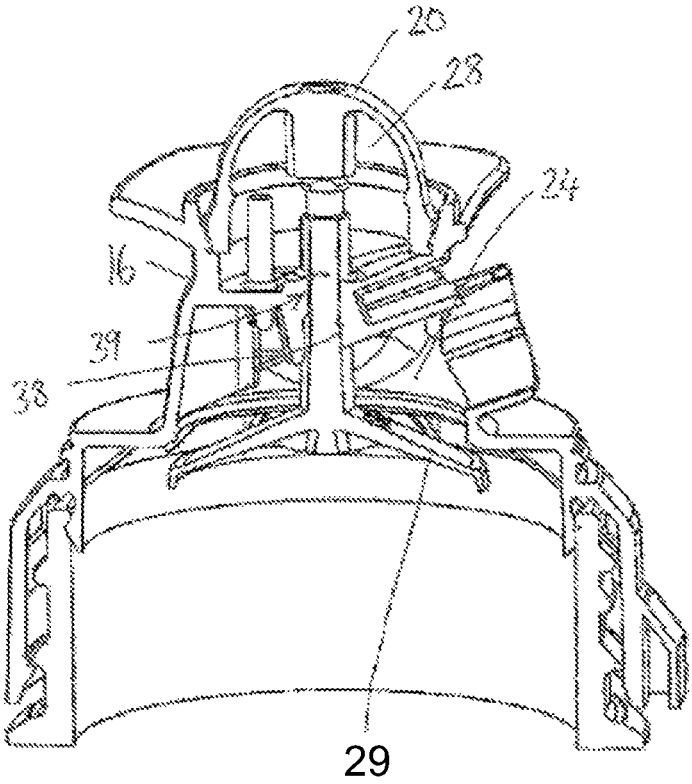
Figure 9:
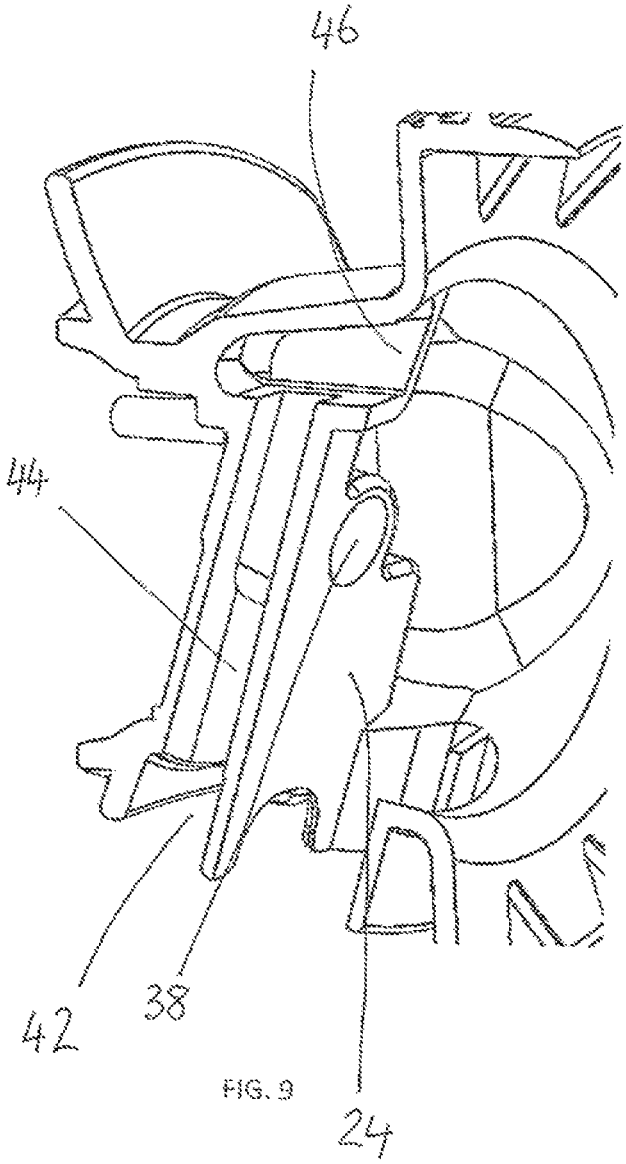
FIG. 9 is a further detailed diagrammatic perspective view of part of the apparatus of FIG. 1.
Figure 10:
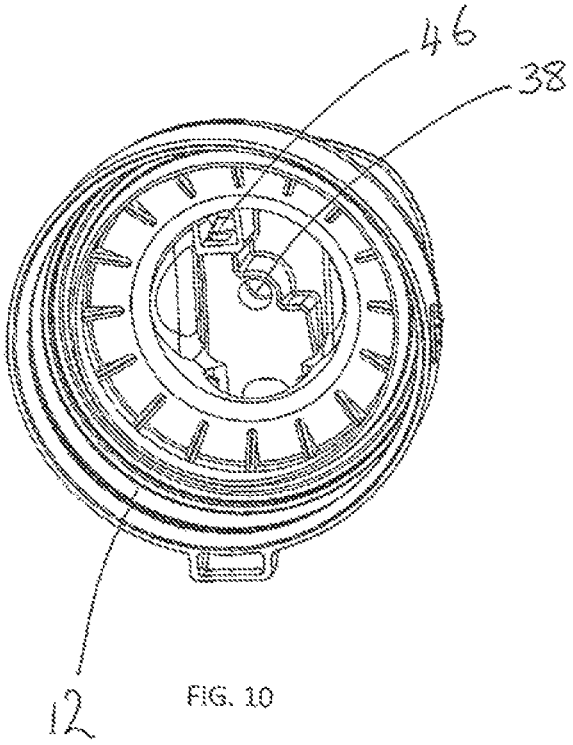
FIG. 10 is a diagrammatic view from the rear of the assembly of FIG. 1.
Figure 11:
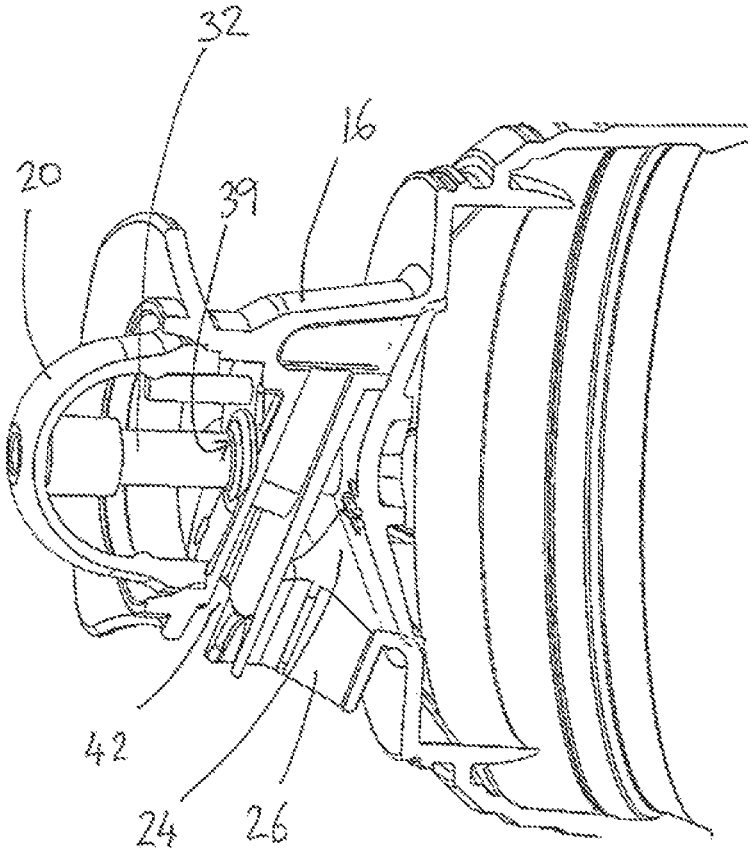
FIG. 11 is a diagrammatic sectional side view through the assembly of FIG. 1.
Figure 12:
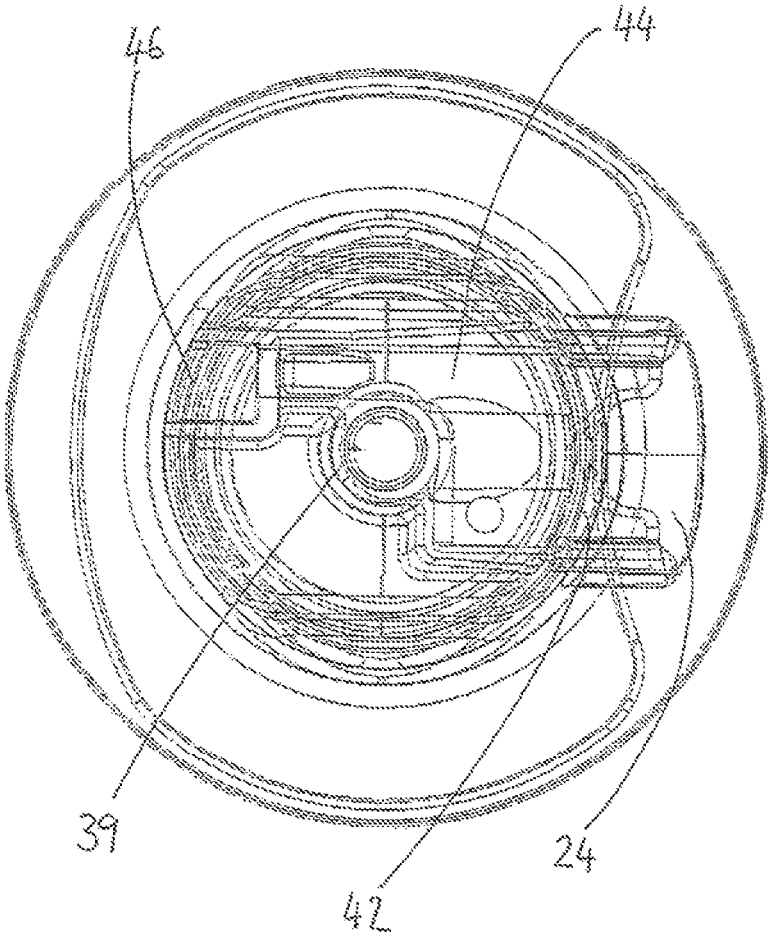
FIGS. 12-14 are respectively front, side and front perspective views of part of the assembly of FIG. 1 illustrating an air intake passage.
Figure 13:
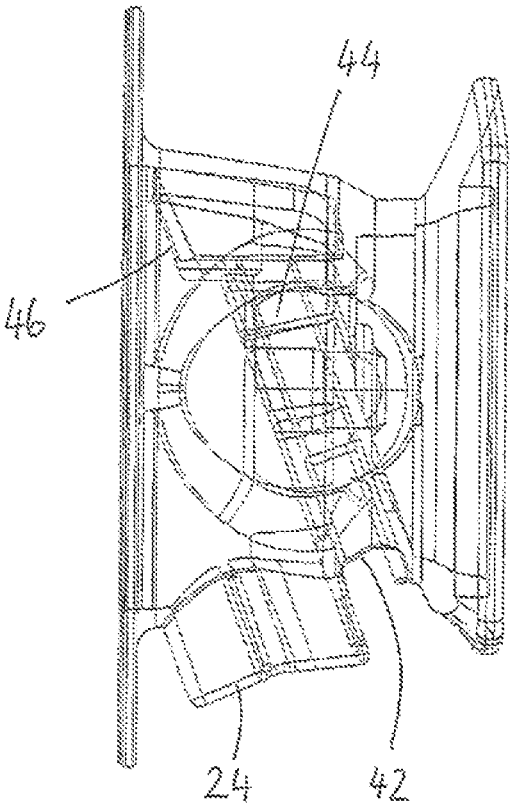
Figure 14:
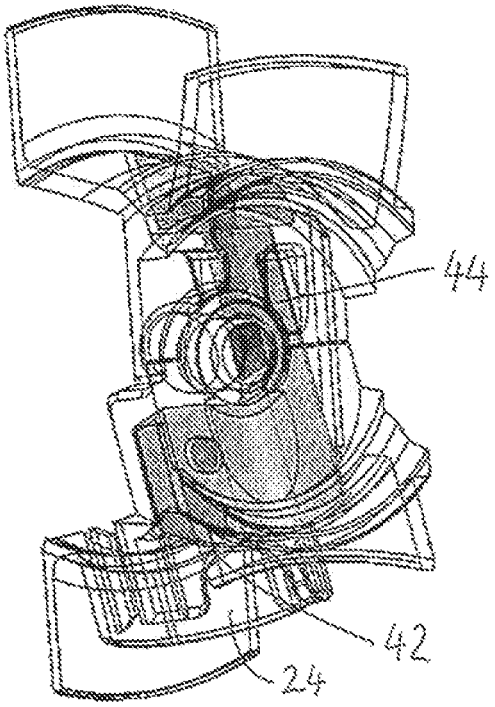

The drawings show a tap assembly 10 mountable on a container for dispensing liquid therefrom, and FIGS. 7 and 8 show the assembly mounted by a screw thread 12 on part of a container 14.

Figure 1:
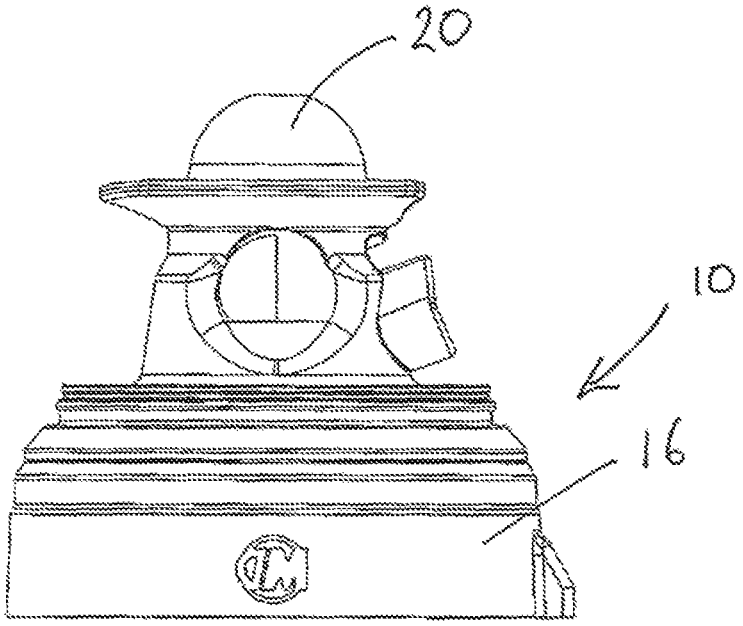
FIG. 1 is a diagrammatic side view of a tap assembly according to the invention but with a cap removed.
Figure 2:
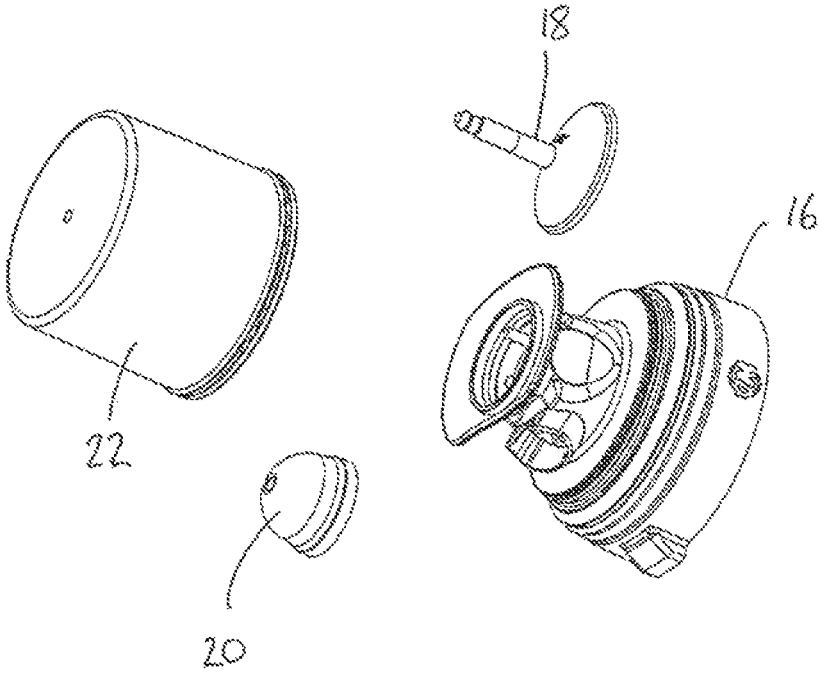
FIG. 2 is a diagrammatic exploded perspective view of the tap assembly of FIG. 1.

FIG. 2 illustrates the main components of the assembly with a partially hollow tap body 16, a valve member 18, a push button 20 and a protective cap 22 which can be push fitted or threadingly mounted on the tap body 16.

Figure 3:
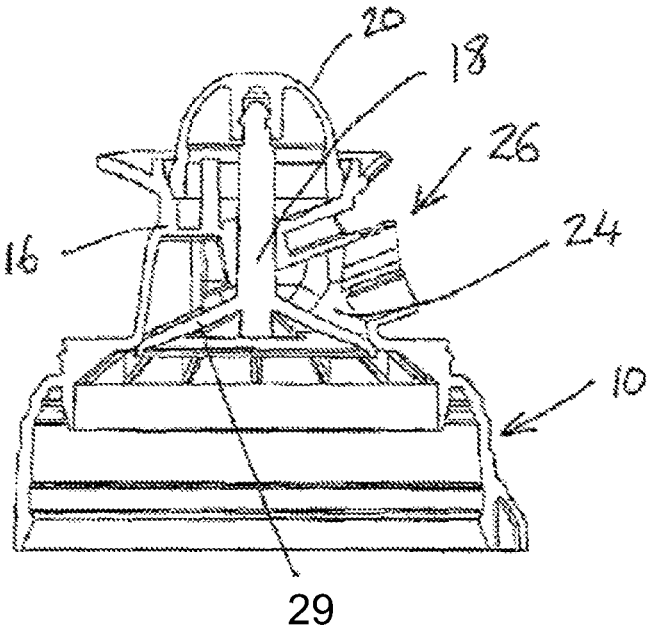
FIG. 3 is a diagrammatic cross sectional view of the tap assembly of FIG. 1 in a closed position.
Figure 4:
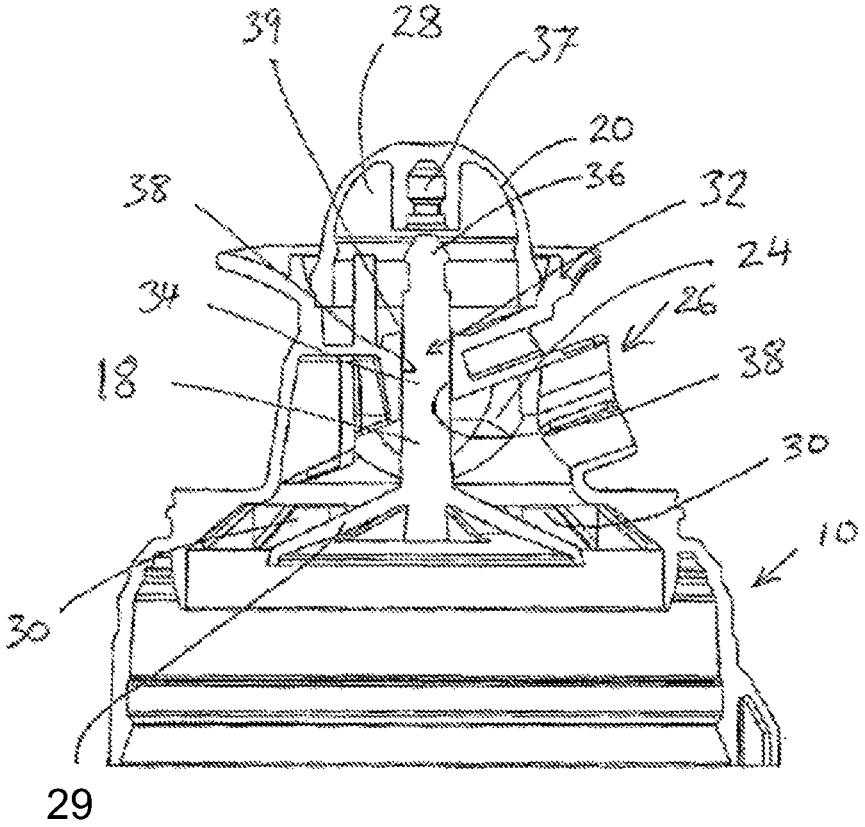
FIG. 4 is a similar view to FIG. 3 but in an open position.
Figure 5:
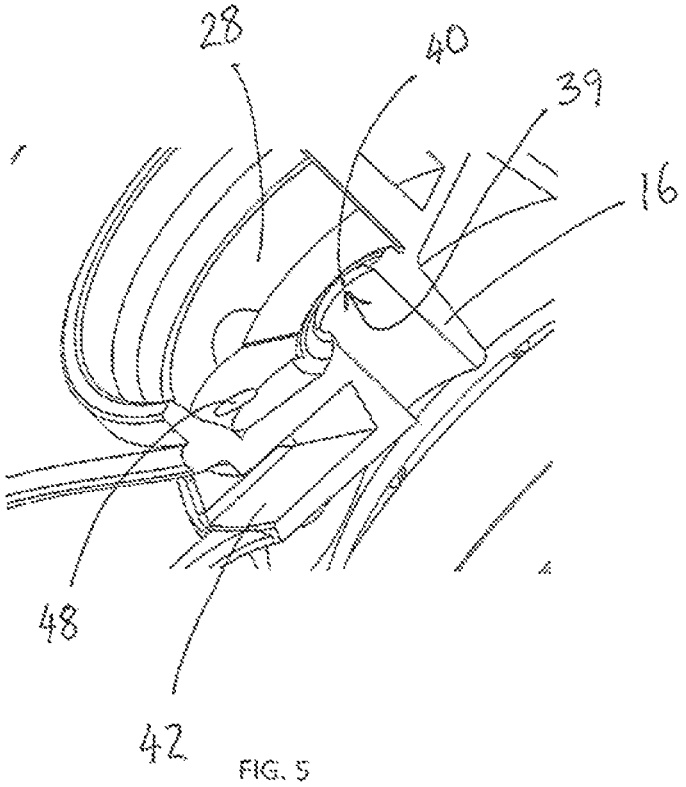
FIG. 5 is a diagrammatic detailed perspective view of part of the assembly of FIG. 1.
Figure 6:
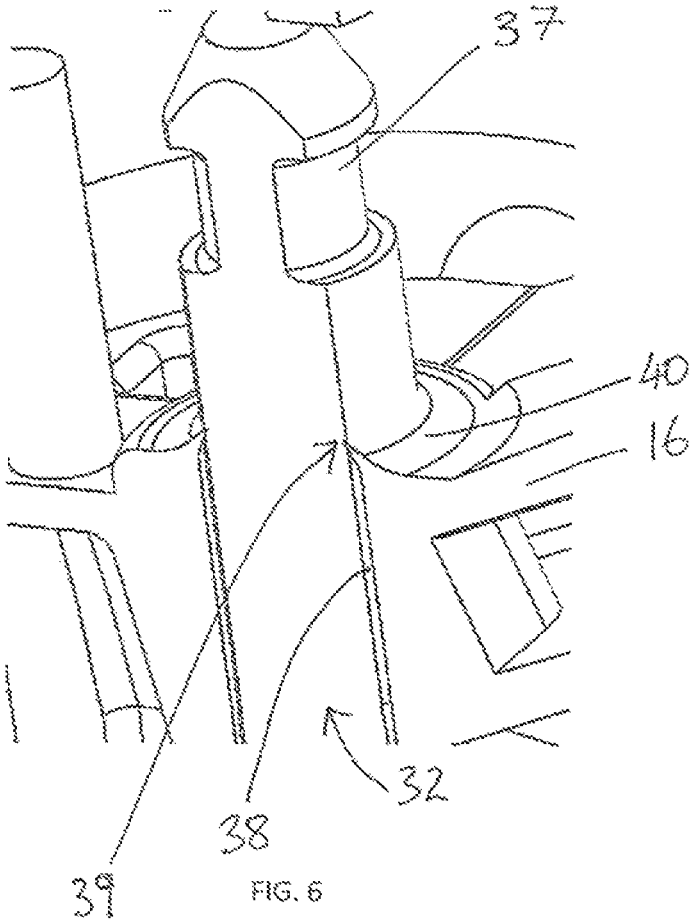
FIG. 6 is a diagrammatic detailed partially cut away view of part of the assembly of FIG. 1.

As shown for instance in FIGS. 3 and 4, the tap assembly 10 includes a body 16 which defines a dispensing chamber 24 leading to an outlet arrangement 26. The dispensing chamber selectively connects through the remainder of the hollow body, the lower part as shown in FIGS. 3 and 4, to the liquid container. A valve assembly which incorporates the valve member 18, selectively closes the connection between the lower part of the tap assembly and the dispensing chamber as shown in FIGS. 3 and 4.

In FIG. 3 the valve member 18 is raised (as shown) closing the connection from the container to the dispensing chamber 24. The resilient push button 20 will in a relaxed condition automatically move the valve member to the raised closed condition shown in FIG. 3.

In FIG. 4 the push button 20 has been pushed to open the tap assembly 10, but the push button 20 shown in FIG. 4 for clarity is not shown as deformed. Movement of the push button 20 has moved the valve member 18 downwardly as shown, such that liquid can pass either side of the valve member 18 and out through the outlet arrangement 26. It is to be realised that in uses the tap assembly 10 would usually be in the orientation shown in FIGS. 7 and 8, i.e. with the outlet arrangement 26 pointing downwardly and inclined gently outwardly away from the container 14.

A space is provided beneath the push button 20 to define an operating chamber 28 which air can be pushed out of as the push button 20 is pressed to open the tap assembly 10. As can be seen the valve member 18 comprises a domed circular section valve part 29 which closes the entrance 30 to the dispensing chamber 24. A connecting member 32 extends from the valve part 29 and includes a cylindrical stem 34 with a profiled head 36. The profiled head 36 engages in a correspondingly shaped recess 37 in the underside of the push button 20 to mount the end of the push button 20 on the head 36.

As can be seen in particular in FIGS. 3-8 the cylindrical valve stem 34 passes through an opening 38 in the body into the operating chamber 28. A seal 39 is provided at the end of the opening 38 as it enters the operating chamber. The seal is in the form of a swipe seal integrally formed with the remainder of the body providing a thin deformable lip 40, which is deformed by the valve stem 34 and resiliently urged thereon to provide a seal to prevent liquid from the dispensing chamber 24 entering the operating chamber 28 where potentially the liquid could be contaminated by the push button 20.

In practice, it is found that the seal 38 tends to be deformed by between about 0.2 and 0.3 mm by the valve stem 34. FIG. 7 shows the tap assembly 10 closed, where the valve member 18 prevents liquid from entering into the dispensing chamber 24. FIG. 8 illustrates the tap assembly 10 open, with the seal 39 preventing liquid from entering the operating chamber 28.

FIGS. 9 to 14 show a further feature of the tap assembly 10, in providing an air return for air to enter the container 14 as liquid is dispensed therefrom. The air intake includes an air inlet 42 which is located adjacent the outlet arrangement 26, but in use above the outlet arrangement 26. The air inlet 42 connects via a channel 44 which narrows in size to pass just to one side of the part of the body 16 through which the opening 38 extends, with the channel 44 not connecting with the opening 38. The channel 44 connects to an air outlet 46 extending into the dispensing chamber 24 at an upper point in use. In practice liquid will pass through the outlet arrangement 26 with air passing back through the air inlet channel 44, without being in contact with the opening 38 nor the operating chamber 28. The air inlet channel 44 is shown shaded in FIGS. 12 to 14 for clarity.

Figure 15:
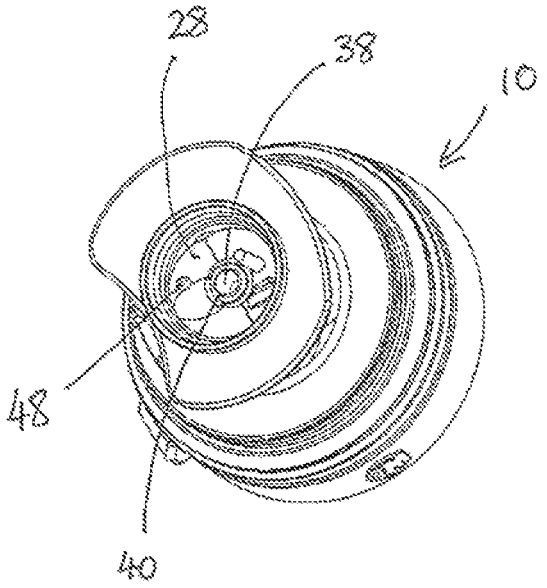
FIG. 15 is a diagrammatic front perspective view of part of the apparatus of FIG. 1.
Figure 16:
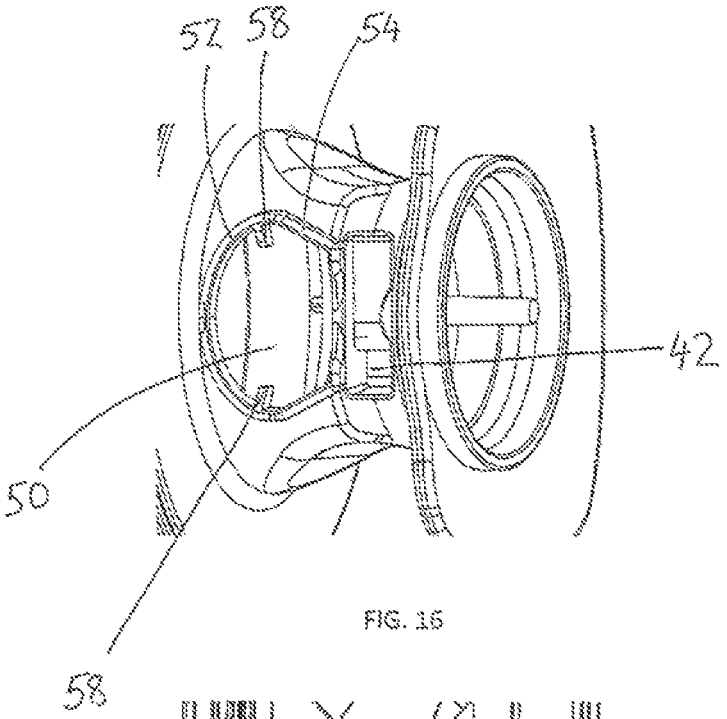
FIG. 16 is a diagrammatic perspective side view of the apparatus of FIG. 1.
Figure 17:
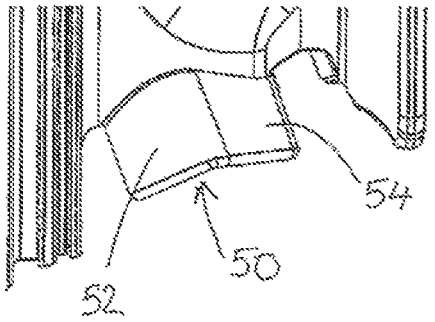
FIG. 17 is a diagrammatic side view of part of the apparatus of FIG. 1.
Figure 18:
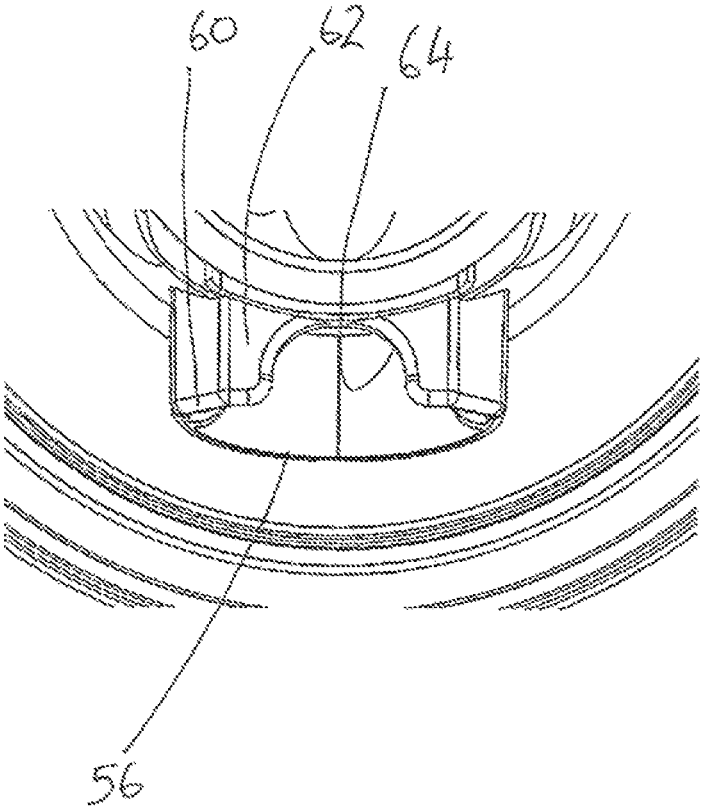
FIG. 18 is a diagrammatic front view of part of the apparatus of FIG. 1.
Figure 19:
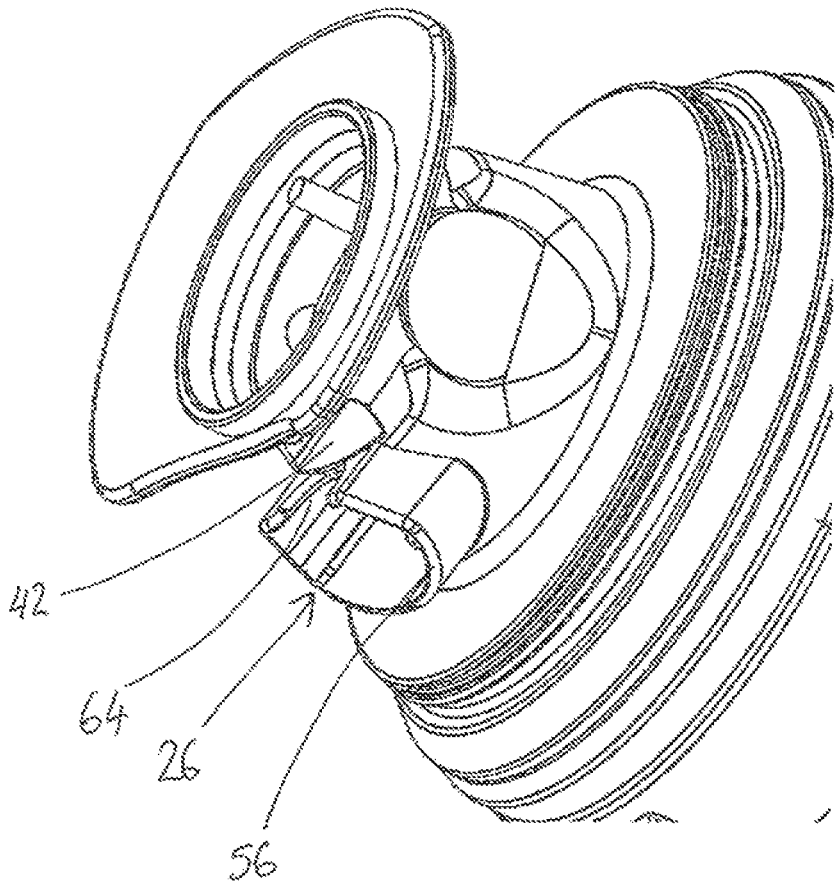
FIG. 19 is a diagrammatic perspective side view of part of the apparatus of FIG. 1.
Figure 20:
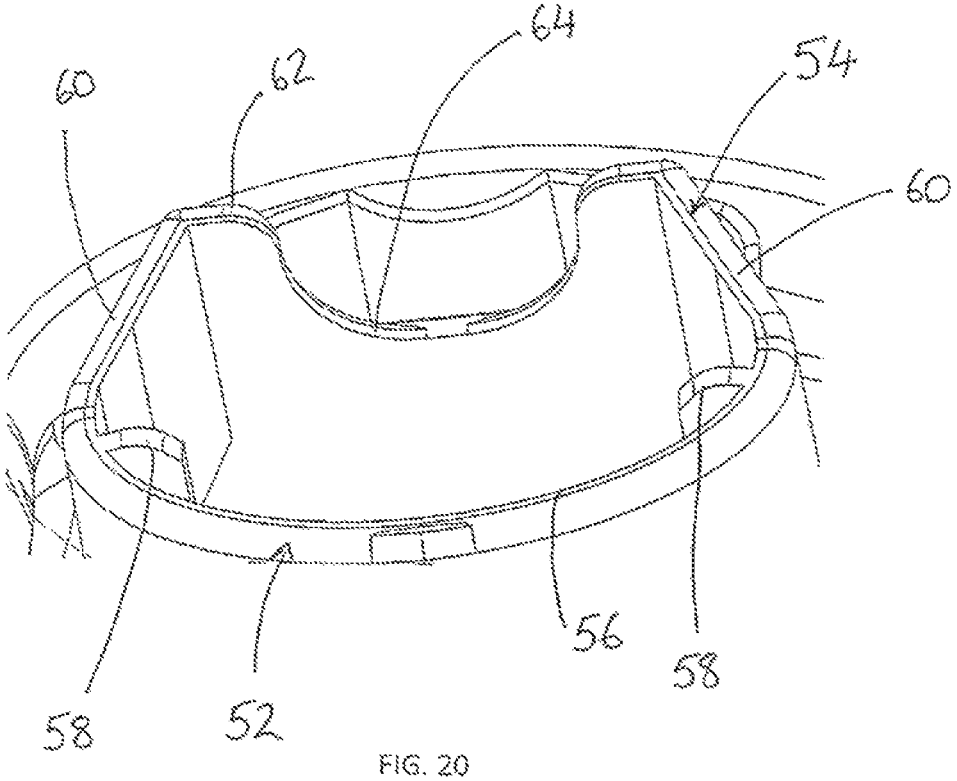
FIG. 20 is a diagrammatic perspective view from beneath the part of the apparatus of FIG. 1.

As shown in for instance FIG. 15, a small air vent 48 is provided in the operating chamber 28 to allow air to vent as the push button 20 is pressed into the chamber 28. As shown for example in FIG. 12, the air vent 48 enters the air inlet channel 44 adjacent the air inlet 42, and on the opposite side of the opening 38 to that which the air inlet channel 44 passes. Air therefrom will therefore immediately be vented to atmosphere.

FIGS. 16 to 20 illustrate the outlet arrangement 26 for the assembly 10, and in particular the spout 50 of the outlet arrangement 26. As can be seen for instance in FIG. 17, in use the outlet arrangement 26 is spaced below the air inlet 42. In side view it can be seen that the spout 50 includes first and second parts 52, 54, with the first part 52 being inclined at a greater angle to the horizontal than the second part 54. The first part 52 includes a substantially planar arcuate edge 56 extending for around 180°, with two fins 58 extending inwardly for around 12% of the diameter of the arcuate edge 56. The fins 58 are symmetrical about a centre line of the first part 52.

The second part 54 includes two converging edges 60 at the indicated lesser inclination to the horizontal. Extending between the inner ends of the edges 60, is a recessed part 62 with a recess 64, which extends for over 40% of the diameter of the first part 52, and to a depth of at least 20% of the diameter of the first part 52.

In use it has been found that the recess 64 prevents a meniscus forming across the spout 50, which otherwise could result in liquid becoming trapped and becoming stale. The fins 58 have been found to improve the flow of liquid through the spout 50.

It has therefore been found that the described assembly 10 provides a number of advantageous features relative to previous tap assemblies. The assembly is however of relatively conventional configuration and can thus be inexpensively manufactured for long term and reliable operation.

It is to be realised that various modifications may be made without departing from the scope of the invention. For instance the above dimensions and proportions may be varied as required. A different form of seal may be possible between the connecting member and the body. The air inlet passage may be differently configured. A different vent arrangement for the operating chamber may be provided.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A tap assembly, the tap assembly including:

a partially hollow body which defines a dispensing chamber within the partially hollow body with a liquid inlet and a liquid outlet, the liquid inlet being located to receive liquid to be dispensed by the tap assembly, the liquid outlet connecting to an outlet arrangement for the tap assembly;

a valve assembly to selectively open the liquid inlet of the dispensing chamber, the valve assembly including a valve element selectively movable between a position closing the liquid inlet of the dispensing chamber and a position permitting liquid to pass therethrough;

a push button for operating the valve assembly, the push button defining an operating chamber against a part of the partially hollow body, such that as the push button is pushed to operate the valve assembly the push button moves into the operating chamber; and a connecting member which extends from the push button through the operating chamber, through an opening in the part of the partially hollow body, and into the dispensing chamber to the valve element, with a seal provided in the opening in the part of the partially hollow body and extending from a top edge of the opening into the operating chamber to prevent liquid passing from the dispensing chamber to the operating chamber.

2. The tap assembly according to claim 1, wherein the seal comprises a deformable part which is deformed by the connecting member extending through the opening such that the deformable part forms a swipe seal against the connecting member.

3. The tap assembly according to claim 2, wherein the deformable part is in a form of a lip around the opening and extending upward, which is inclined away from the dispensing chamber.

4. The tap assembly according to claim 3, wherein the lip is deflected by the connecting member extending through the partially hollow body by between 0.1 and 0.4 mm.

5. The tap assembly according to claim 3, wherein the lip is integrally formed with a remainder of the partially hollow body.

6. The tap assembly according to claim 1, wherein at least a portion of the connecting member which extends through the opening is cylindrical.

7. A tap assembly, the tap assembly including:

a partially hollow body which defines a dispensing chamber within the partially hollow body with a liquid inlet and a liquid outlet, the liquid inlet being located to receive liquid to be dispensed by the tap assembly, the liquid outlet connecting to an outlet arrangement for the tap assembly;

a valve assembly to selectively open the liquid inlet of the dispensing chamber, the valve assembly including a valve element selectively movable between a position closing the liquid inlet of the dispensing chamber and a position permitting liquid to pass therethrough;

a push button for operating the valve assembly, the push button defining an operating chamber against a part of the partially hollow body, such that as the push button is pushed to operate the valve assembly the push button moves into the operating chamber; and a connecting member which extends from the push button through the operating chamber, through an opening in the part of the partially hollow body, and into the dispensing chamber to the valve element, the outlet arrangement including a spout having a linear edge and an arcuate edge opposite the linear edge, with a recess in the linear edge, wherein the arcuate edge is positioned closer to the liquid inlet than the linear edge.

8. The tap assembly according to claim 7, wherein the recess extends for at least 40% of a width of the spout.

9. The tap assembly according to claim 7, wherein the recess has a depth of at least 20% of a width of the spout.

10. The tap assembly according to claim 7, wherein the spout includes a pair of opposed fins extending into the spout from the arcuate edge.

11. The tap assembly according to claim 10, wherein the fins extend for between 10 and 20% of a width of the spout.

12. The tap assembly according to claim 10, wherein the fins are symmetrical about a central line through the recess.

13. The tap assembly according to claim 7, wherein the spout includes a first part with at least generally arcuate walls which extend for at least 180°, and a second part interconnecting ends of the first part, the second part including the recess.

14. The tap assembly according to claim 13, wherein the spout is symmetrical about a line extending through centers of the first and second parts.

15. The tap assembly according to claim 13, wherein lower edge of the walls of the first part is substantially planar.

16. The tap assembly according to claim 15, wherein the lower edge of the walls of the first part is inclined relative to the lower edge of the walls of the second part adjoining the first part, with the lower edge of the walls of the first part at a greater inclination in use to horizontal than the lower edge of the walls of the second part adjoining the first part.

17. The tap assembly according to claim 13, wherein fins are provided on the first part and extend into the spout from the arcuate edge.

18. The tap assembly according to claim 7, wherein the push button is made of a deformable resilient material.

19. The tap assembly according to claim 7, wherein a selectively removable cap extends over the partially hollow body of the tap assembly.

* * * * *